US009808086B1

(12) United States Patent
Stokeley

(10) Patent No.: US 9,808,086 B1
(45) Date of Patent: Nov. 7, 2017

(54) SEATING ARRANGEMENT SYSTEM

(71) Applicant: Bobby Lee Stokeley, Brooklyn, NY (US)

(72) Inventor: Bobby Lee Stokeley, Brooklyn, NY (US)

( * ) Notice: Subject to any disclaimer, the term of this patent is extended or adjusted under 35 U.S.C. 154(b) by 0 days.

(21) Appl. No.: 15/236,935

(22) Filed: Aug. 15, 2016

(51) Int. Cl.
*A47C 1/00* (2006.01)
*A47C 1/124* (2006.01)
*A47B 91/08* (2006.01)
*E04F 15/02* (2006.01)

(52) U.S. Cl.
CPC ..... *A47C 1/124* (2013.01); *A47B 91/08* (2013.01); *E04F 15/02033* (2013.01); *E04F 15/02044* (2013.01); *E04F 15/02161* (2013.01)

(58) Field of Classification Search
CPC ..... A47B 91/08; E04F 15/02033; E04F 15/02044; E04F 15/02161; E04F 2201/0161; E04F 2203/04; A47C 1/124
See application file for complete search history.

(56) References Cited

U.S. PATENT DOCUMENTS 4,596,095 A * 6/1986 Chalfant ..... E04F 15/02458 52/126.6
5,392,571 A * 2/1995 Greenfield ..... E04F 15/02447 52/126.2
5,455,388 A * 10/1995 Pratt ..... H02G 3/185 174/67
5,467,609 A * 11/1995 Feeney ..... E04F 15/02411 52/220.2
5,477,649 A * 12/1995 Bessert ..... H02G 3/285 174/486
5,483,776 A * 1/1996 Poppe ..... H02G 3/285 174/486
5,627,340 A * 5/1997 Smith ..... H02G 3/185 174/482
5,927,030 A * 7/1999 Petit ..... E04F 15/02458 52/220.1
5,983,582 A * 11/1999 Vugrek ..... E04F 15/02458 52/126.6
6,513,756 B1 * 2/2003 Lambiaso ..... B64D 11/0015 244/118.5
6,748,707 B1 * 6/2004 Buchalter ..... E04F 15/024 439/131
9,028,005 B2 * 5/2015 Sprinkle ..... A47C 7/002 297/463.1
2011/0298256 A1 * 12/2011 Suprina ..... A47C 1/12 297/232

* cited by examiner

*Primary Examiner* — Beth Stephan
(74) *Attorney, Agent, or Firm* — Dunlap Bennett & Ludwig PLLC

(57) ABSTRACT

A seating arrangement system for securing the spacing of a predetermined arrangement of seating is provided. The seating arrangement system embodies a plurality of movable tiles forming a supporting surface for securing the predetermined arrangement of movable seats, wherein each tile associated with a vertical member of each seat is selectively pivoted to an opening configuration, exposing a base aperture into which the vertical member is secured. The remaining tiles being selectively maintained in the closed configuration, providing an even surface for traversing about the predetermined arrangement of movable seats.

7 Claims, 5 Drawing Sheets

SEATING ARRANGEMENT SYSTEM

BACKGROUND OF THE INVENTION

The present invention relates to seating arrangements and, more particularly, to a seating arrangement system for keeping the arrangement of seating in place, thereby facilitating clear space between adjacent rows of seats.

Venues, commercial and residential, used for entertaining, performances, and sports events, wherein the venues utilize an arrangement of rows of individual seating, need to keep the rows and aisles free and clear for providing a safe and orderly venue.

Such venues, however, do not have a system of keeping their seating in place, and so the rows and aisles become uneven, making it difficult to traverse through the aisles and between adjacent rows of seats, requiring constant readjustment of rows and chairs. Furthermore, this predicament creates a fire and safety hazard in the case of an emergency.

As can be seen, there is a need for a system that keeps an arrangement of seating in place, thereby facilitating clear space between adjacent rows of seats.

SUMMARY OF THE INVENTION

In one aspect of the present invention, a system for securing a predetermined arrangement of movable seats includes at least one frame, each frame providing a plurality of frame openings; a base sheet coextensively joined to each frame; a plurality of base apertures provided along said base sheet so that each base aperture is circumscribed by each respective frame opening of the plurality of frame openings; and a tile pivotally connected to each respective frame opening of the plurality of frame openings to be movable between a closed configuration and an open configuration exposing the associated base aperture.

In another aspect of the present invention, the system for securing a predetermined arrangement of movable seats further includes a first surface and an opposing second surface, wherein the first surface provides at least one attachment point provided by, wherein a pair of opposing hinge slots are provided along an inner edge of each frame opening for pivotally connecting the associated tile; further including a snap-in protrusion provided by each second surface; a pair of pivotal connectors interconnecting each associated snap-in protrusion and a respective pair of opposing hinge slots, wherein the snap-in protrusion is arranged to urge said pair of pivotal connectors together; a distal edge element pivotally connected to a distal edge of each tile adjacent to the inner edge of each frame opening so that the distal edge element is movable between an open condition and a closed condition, wherein the open condition is a prerequisite to moving the tile to the open configuration; and further including a proximal edge element pivotally connected to a proximal edge opposing the distal edge of each tile so that the proximal edge element is movable between an open condition and a closed condition; a L-shape latch arm pivotally connected to each end of at least one U-shape latch base, wherein the at least one U-shape latch base is joined to one or more of the at least one attachment point.

In yet another aspect of the present invention, a method of securing a predetermined arrangement of a plurality of movable seats includes providing the above mentioned system; arranging the at least one frame as a supporting surface for the plurality of movable seats, and for each selected tile under at least one vertical member of each of the plurality of movable seats, moving said selected tile to the open configuration; and sliding said at least one vertical member of each of the plurality of movable seats in the exposed base aperture associated with each said selected tile.

These and other features, aspects and advantages of the present invention will become better understood with reference to the following drawings, description and claims.

DETAILED DESCRIPTION OF THE INVENTION

Figure 1:
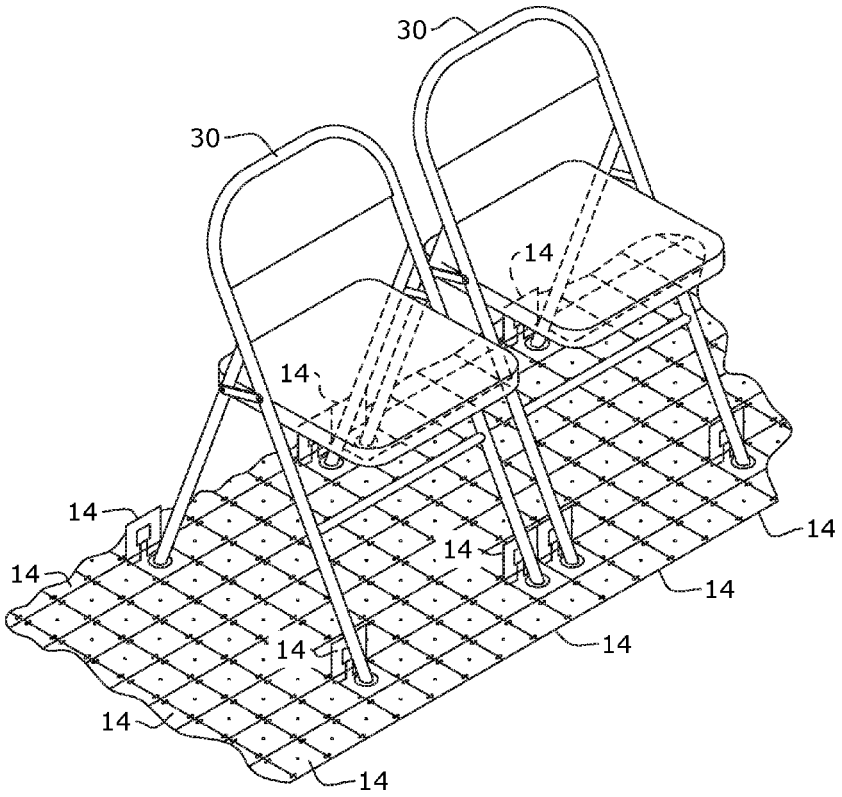
FIG. 1 is a perspective view of an exemplary embodiment of the present invention, shown in use.
Figure 2:
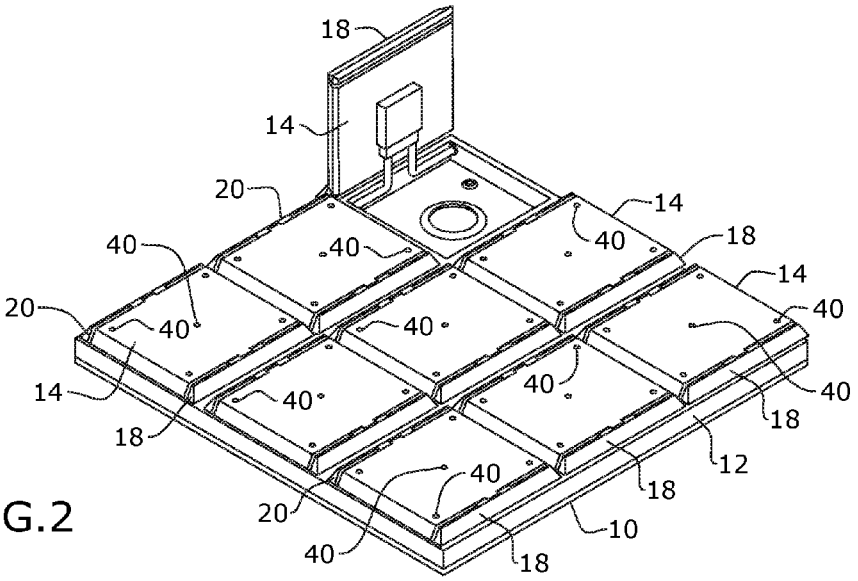
FIG. 2 is a perspective view of an exemplary embodiment of the present invention, shown in an open configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a seating arrangement system for securing the spacing of a predetermined arrangement of seating. The seating arrangement system embodies a plurality of movable tiles forming a supporting surface for securing the predetermined arrangement of movable seats, wherein each tile associated with a vertical member of each seat is selectively pivoted to an opening configuration, exposing a base aperture into which the vertical member is secured. The remaining tiles being selectively maintained in the closed configuration with providing an even surface for traversing about the predetermined arrangement of movable seats.

Referring to FIGS. 1 through 9, the present invention may include a seating arrangement system for keeping an arrangement of seating, thereby facilitating a clear space between adjacent rows of seats. The seating arrangement system embodies a plurality of movable tiles 14 secured within at least one frame 12, wherein multiple frames 12 may be positioned adjacent each other forming a supporting surface for securing a predetermined arrangement of seating, wherein the seating can include chairs 30, benches 32 and the like.

Figure 4:
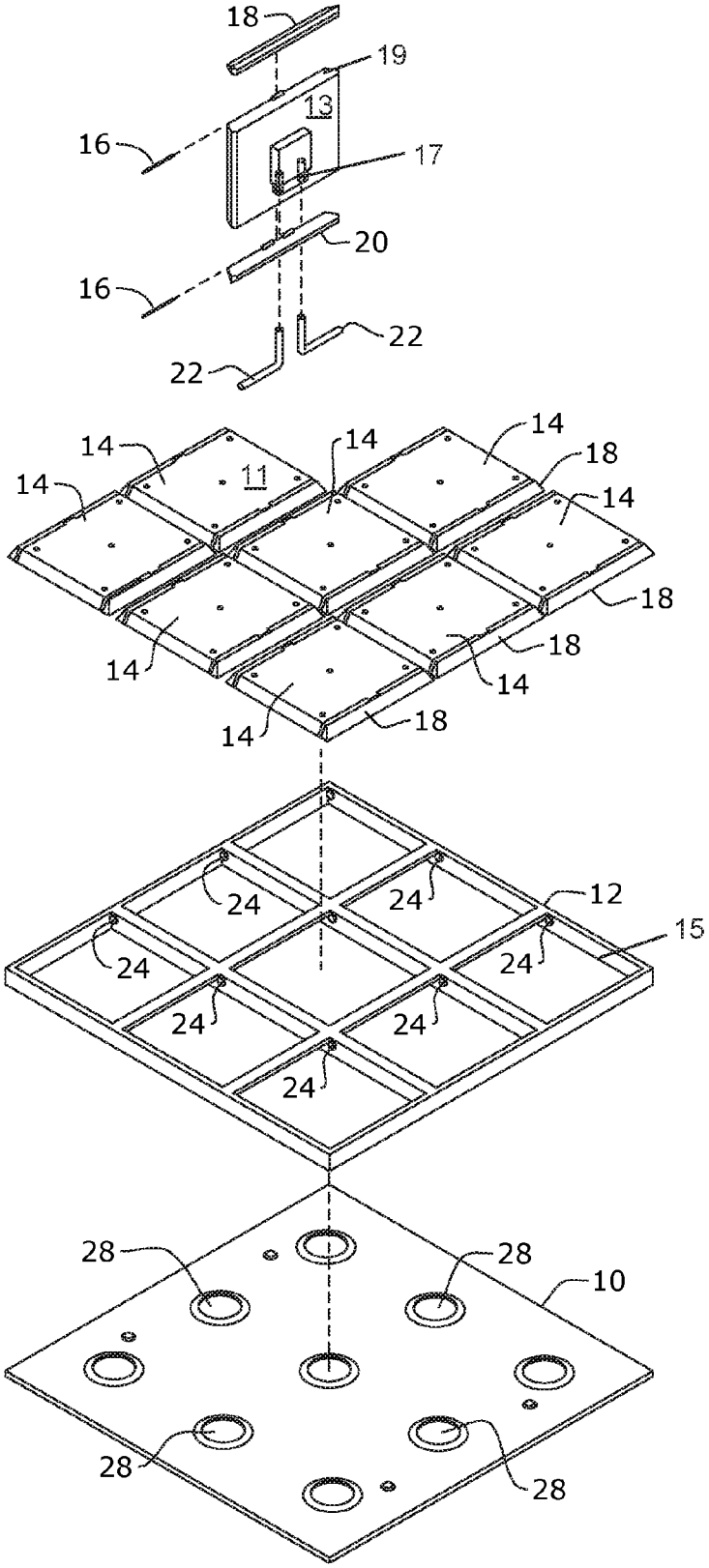
FIG. 4 is an exploded view of an exemplary embodiment of the present invention.

Each frame forms a plurality of frame openings 15, typically in a grid-like pattern, as illustrated in FIG. 4. It will be apparent to those skilled in the art that the frame openings 15 may be designed in a variety of different sizes and geometrical configurations so long as they function in accordance with the present invention as described herein, for example the frame openings 15 may be 2×2, 4×2, 4×4 inches and the like. The frame 12 attaches to a generally coextensive base sheet 10. A plurality of base apertures 28 are provided along the base sheet 10 so that each base aperture 28 is generally centrally disposed within an associated frame opening 15.

Along an inner edge, each frame opening 15 may provide a pair of opposing hinge slots 24, as illustrated in FIG. 4. Each tile 14 is dimensioned to be generally coextensive with an associated frame opening 15, wherein each tile 14 may be pivotally connected thereto by way of a pair of pivotal connector 22 engaging the pair of opposing hinge slots 24 so as to move between a closed configuration and an open configuration exposing the associated frame opening 15 and its respective base apertures 28. Each tile 14 may have a first surface 11 and an opposing second surface 13 interconnected by sidewalls 19, as illustrated in FIG. 4. The second surface 13 may provide a centrally disposed snap in protrusion 17 for engaging the pivotal connector 22, wherein the snap in protrusion 17 may provide receiving holes 26 for slidably receiving the pivotal connectors 22. The pivotal connectors 22 may be adapted to be snap-in by urging opposing pivotal connectors 22 together—enabled by the snap in protrusion 17—so that the proximal ends of the pivotal connectors 22 can engage the opposing hinge slots 24 after releasing the opposing pivotal connectors 22.

Figure 3:
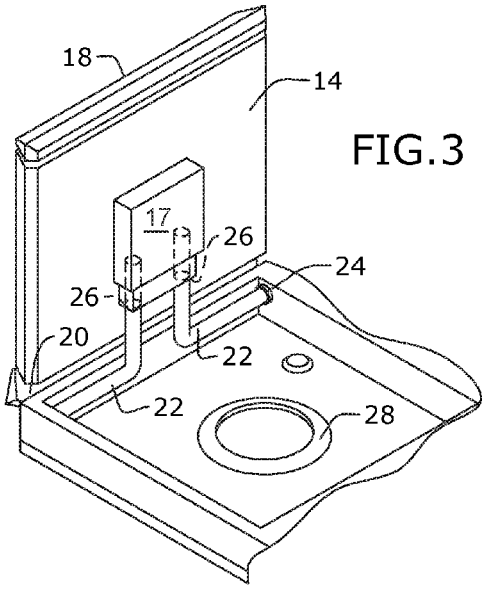
FIG. 3 is an enlarged perspective view of an exemplary embodiment of the present invention.
Figure 6:
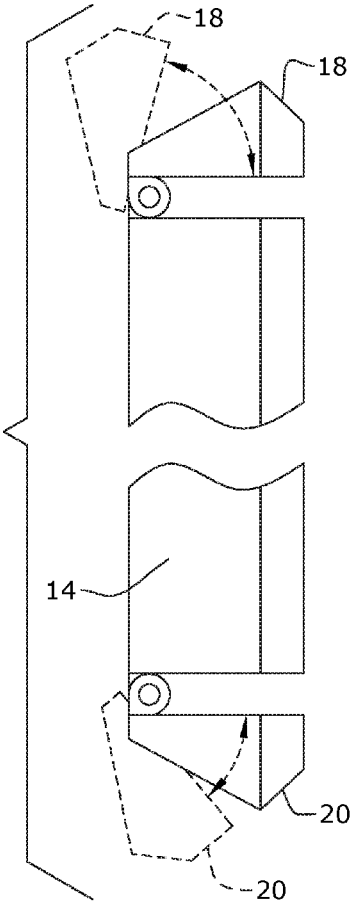
FIG. 6 is an enlarged section view of an exemplary embodiment of the present invention.
Figure 5:
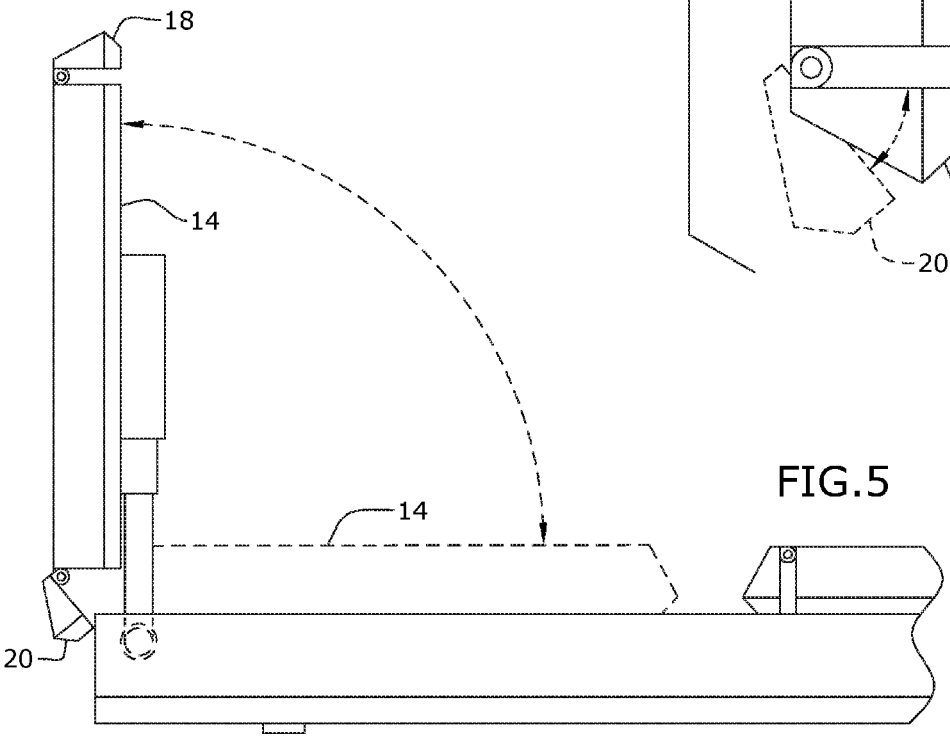
FIG. 5 is a section view of an exemplary embodiment of the present invention.

A distal edge element 18 and a proximal edge element 20 may be pivotally connected to opposing sides of each tile 14, wherein the proximal edge element 20 approximately aligns with the inner edge of the frame opening 15 providing the pair of opposing hinge slots 24, as illustrated in FIG. 3. The pivotal edge connectors 16 enables the edge elements 18 and 20 to move between a closed condition and an open condition. The closed condition enables the tile 14 and edge elements 18 and 20 to completely cover the associated frame opening 15, while the open condition allows the tile 14 to be move between the open and closed configurations, as illustrated in FIG. 5.

Figure 7:
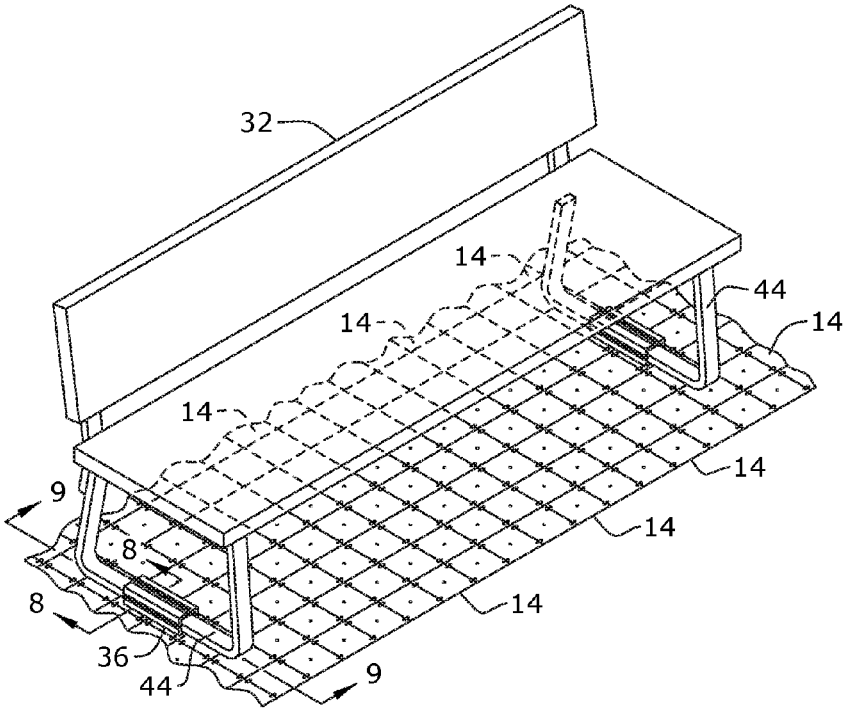
FIG. 7 is a perspective view of an exemplary embodiment of the present invention.
Figure 8:
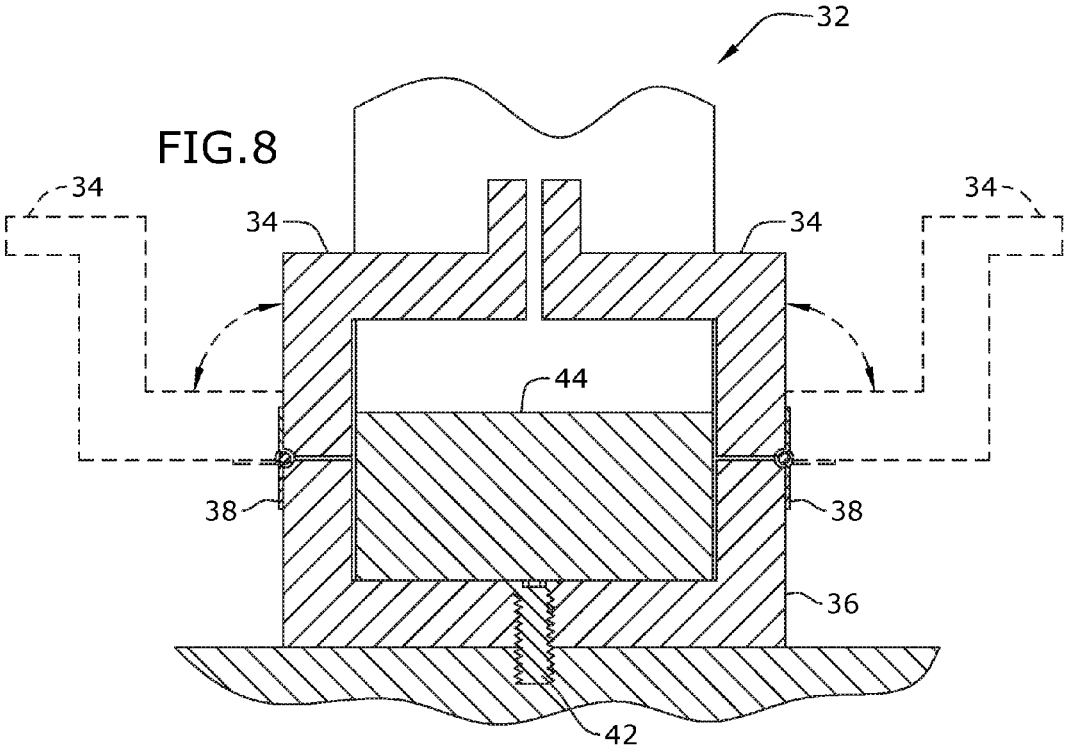
FIG. 8 is a section view of an exemplary embodiment of the present invention, taken along line 8-8 of FIG. 7.
Figure 9:
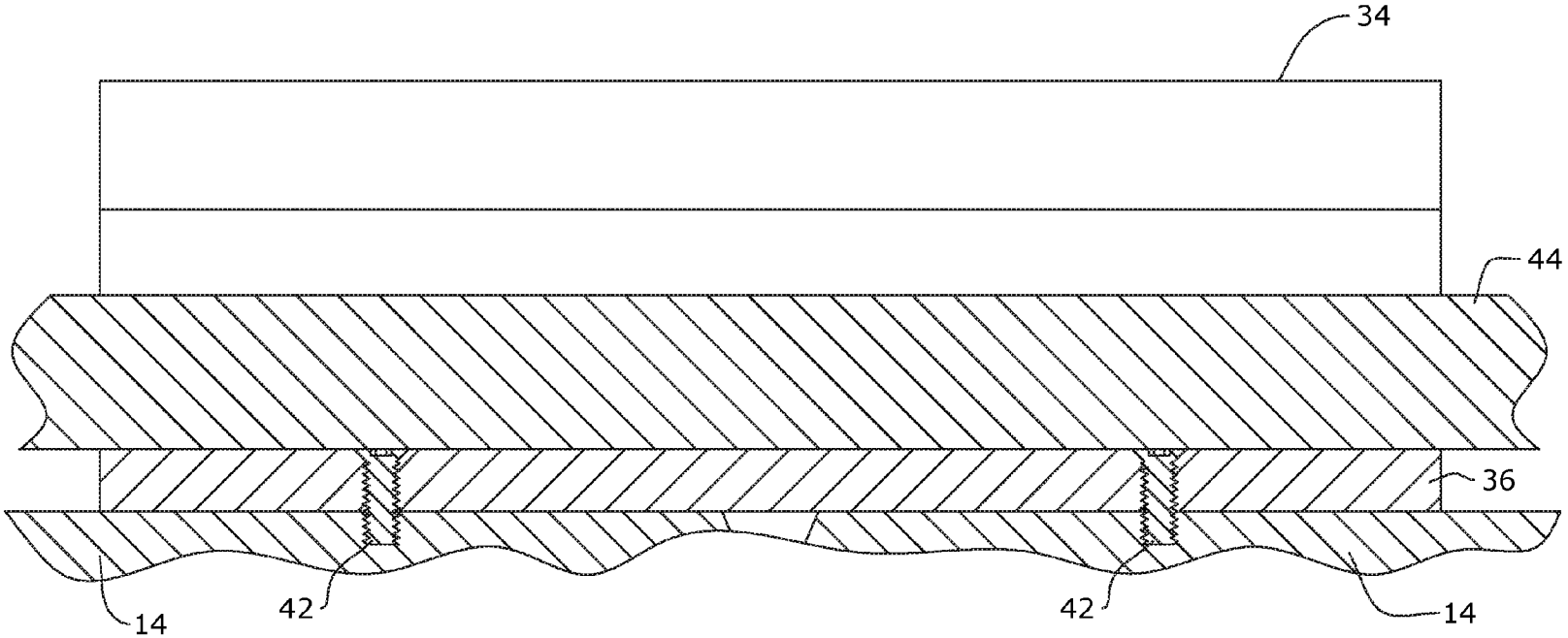
FIG. 9 is a section view of an exemplary embodiment of the present invention, taken along line 9-9 of FIG. 7.

The first surface 11 of each tile 14 may provide a plurality of attachment points 40. In certain embodiments, a U-shaped latch base 36 may be mounted to at least one attachment point 40 by an attachment 42, such as a mounting bolt. An L-shape latch arm 34 may be pivotally connected by a hinge 38 to each of the ends of the U-shape of the latch base 36, so that the opposing latch arms 34 of an associated latch base 36 moves between an unlocked condition and a locked condition securing a horizontal member 44 of the seating within the U-shaped latch base 36, as illustrated in FIGS. 7-9.

A method of using the present invention may include the following. A user may provide the seating arrangement system disclosed above. The user may place a plurality of frames 12 adjacent to each other on a flooring so as to provide a supporting surface onto which a predetermined arrangement of seating may be arranged. Then in certain embodiments, the user may move tiles 14 adjacent to at least one vertical member of the seating—i.e., the leg of a chair 30—to the opening configuration so that said at least one leg may be slidably received in the associated base aperture 28, thereby bracing the chair 30 preventing it from moving and thus maintaining the predetermined arrangement of seating. Note, the vertical member need not be completely vertical, it may be slanted. When the predetermined arrangement of seating is no longer needed, the plurality of frames 12 may be removed returning the flooring to its original state, and so protecting the flooring from being damaged during the use of the predetermined arrangement of seating.

Where the seating has horizontal members 44, such as a bench 32, the user can secure the latch base 36 by way of the at least one attachment point 40 so that a portion of said horizontal member 44 nests into the 'U' of the latch base 36 when its associated latch arms 34 are in the unlocked configuration. Then the user moves the associated latch arms 34 to the locked configuration, thereby bracing the bench 32 preventing it from moving and maintaining the predetermined arrangement of seating, as illustrated in FIGS. 7-9. As a result, a clear space between adjacent rows of seats is maintained, facilitating safe passage there between.

In certain embodiments, the first surface 11 may provide (or enables the providing of) graphical printing, so that tiles 14 in the closed configuration may form a portion of a larger, congruent image. In other embodiments, the first surface 11 may provide a carpeting, ceramic, or the like covering.

In certain embodiments, the seating arrangement system may be disposed along a vertical surface, such as a wall, whereby articles are secured thereto.

It should be understood, of course, that the foregoing relates to exemplary embodiments of the invention and that modifications may be made without departing from the spirit and scope of the invention as set forth in the following claims.

What is claimed is:

1. A system for securing a predetermined arrangement of movable seats, comprising:

at least one frame, each frame providing a plurality of frame openings;

a base sheet coextensively joined to each said frame;

a plurality of base apertures provided along said base sheet so that one of the base apertures is circumscribed by one of the plurality of frame openings;

a tile pivotally connected to each respective frame opening of the plurality of frame openings to be movable between a closed configuration and an open configuration exposing one of the base apertures, wherein each said tile has a first surface and an opposing second surface, and further comprising at least one attachment point provided by the first surface;

a pair of opposing hinge slots along an inner edge of each said frame opening for pivotally connecting one of the tiles; and a snap-in protrusion provided by each said second surface; and further comprising a pair of pivotal connectors interconnecting each said snap-in protrusion and each said pair of hinge slots, wherein the snap-in protrusion is arranged to urge said pair of pivotal connectors together.

2. The system of claim 1, further comprising a distal edge element pivotally connected to a distal edge of each said tile adjacent to the inner edge of each said frame opening so that the distal edge element is movable between an open condition and a closed condition.

3. The system of claim 2, wherein the open condition is a prerequisite to moving said tile to the open configuration.

4. The system of claim 3, further comprising a proximal edge element pivotally connected to a proximal edge opposing the distal edge of each said tile so that the proximal edge element is movable between an open condition and a closed condition.

5. The system of claim 4, further comprising a L-shape latch arm pivotally connected to each end of at least one U-shape latch base, wherein the at least one U-shape latch base is joined to one or more of the at least one attachment point.

6. The system of claim 1, further comprising a L-shape latch arm pivotally connected to each end of at least one U-shape latch base, wherein the at least one U-shape latch base is joined to one or more of the at least one attachment point.

7. A method of securing a predetermined arrangement of a plurality of movable seats, comprising:

providing the system of claim 1;

arranging the at least one frame as a supporting surface for the plurality of movable seats;

providing each said tile under at least one vertical member of each of the plurality of movable seats, moving said tile to the open configuration; and sliding said at least one vertical member of each of the plurality of movable seats in one of the base apertures associated with each said tile.

* * * * *